US006165318A

United States Patent [19]

Paren et al.

[11] Patent Number: 6,165,318

[45] Date of Patent: Dec. 26, 2000

[54] DELIGNIFICATION OF CHEMICAL PULP WITH PEROXIDE IN THE PRESENCE OF A SILICOMOLYBDENIC ACID COMPOUND

[75] Inventors: Aarto Paren, Vantaa; Jukka Jäkärä; Juha Patola, both of Vaasa, all of Finland

[73] Assignee: Kemira Chemicals OY, Helsinki, Finland

[21] Appl. No.: 08/750,659

[22] PCT Filed: Jun. 19, 1995

[86] PCT No.: PCT/FI95/00352

§ 371 Date: Feb. 27, 1997

§ 102(e) Date: Feb. 27, 1997

[87] PCT Pub. No.: WO95/35407

PCT Pub. Date: Dec. 28, 1995

[30] Foreign Application Priority Data

Jun. 20, 1994 [FI] Finland ..... 942969

[51] Int. Cl.[7] ..... D21C 9/16

[52] U.S. Cl. ..... 162/76; 162/78; 162/79; 162/80

[58] Field of Search ..... 162/76, 78, 79, 162/80

[56] References Cited

U.S. PATENT DOCUMENTS

| | | | |
|---|---|---|---|
| 3,865,685 | 2/1975 | Hebbel et al. | 162/78 |
| 4,222,819 | 9/1980 | Fossum et al. | 162/78 |
| 4,400,237 | 8/1983 | Kruger et al. | 162/76 |
| 4,410,397 | 10/1983 | Kempf | 162/78 |
| 4,427,490 | 1/1984 | Eckert | 162/78 |
| 4,661,205 | 4/1987 | Ow et al. | 162/78 |

FOREIGN PATENT DOCUMENTS

| | | | |
|---|---|---|---|
| 1129161 | 8/1982 | Canada . | |
| 402 335 | 12/1990 | European Pat. Off. | 162/76 |

OTHER PUBLICATIONS

Kubelka V., Francis R.C., Dence C.W., "Delignification with acidic hydrogen peroxide activated by molydate," *Journal of Pulp and Paper Science*: vol. 18, No. 3, May 1992, pp. J108–J114.

Weinstock I.A., Springer E.L., Minor J.L., Atalla R.H., "Alternative pathaways in non–chlorine bleaching," *Non–chlorine bleaching conference*, Mar. 14–18, 1993. S. Carolina, USA.

Sundman G.I., Ph.D. dissertation, SUNY College Environment Science and Forestry, Syracuse, USA, 1988.

*Primary Examiner*—Steve Alvo

*Attorney, Agent, or Firm*—Morgan & Finnegan, L.L.P.

[57] ABSTRACT

A process for the delignification of a chemical pulp, such as a sulfate or sulfite pulp, in which process the pulp is treated with a peroxide and/or a peracid in the presence of an activating Ti-, V- or Cr-group transition metal, such as molybdenum, vanadium or tungsten. A compound containing at least one heteroatom, such as Si, P or B, which is capable of forming a heteropolyacid with the activating transition metal, is added to the pulp. The feeding of the activating transition metal and the heteroatom into the pulp may take place in one and the same alkaline solution, for example introduced into the solution or in the form of a compound of the silicomolybdenic acid type, formed in the solution. The peroxide and/or peracid treatment may constitute part of the bleaching sequence, which contains as potential other treatment steps, for example, a treatment with oxygen and a chelation for the removal of heavy metals such as iron, manganese and/or copper.

8 Claims, No Drawings

DELIGNIFICATION OF CHEMICAL PULP WITH PEROXIDE IN THE PRESENCE OF A SILICOMOLYBDENIC ACID COMPOUND

The present invention relates to a process for the delignification of a chemical pulp, in which process the pulp is treated with a peroxide or a peracid in the presence of an activating Ti-, V- or Cr-group transition metal. The said transition metals include Mo, V, Nb, Ta, Ti, Zr, Hf and W.

After the cooking, chemical pulp is brown, owing to residual lignin present in it. The pulp to be used for higher-grade papers is bleached after cooking in order to remove the lignin.

The bleaching chemical used has conventionally been chlorine, by means of which an effective bleaching is achieved and the quality of the paper obtained is high. However, owing to the environmental problems caused by chlorine, there has recently been to an increasing degree a shift to other bleaching chemicals, such as chlorine dioxide, oxygen, ozone, peroxides, and peracids. The overall objective has been to shift to bleaching which is completely free of chlorine chemicals in order to avoid the environmental hazards caused by chlorine chemicals, and chlorine residues in completed paper.

The bleaching process usually comprises a bleaching sequence made up of successive treatment steps, wherein oxidative steps which decompose lignin and alkaline washing steps alternate. By bleaching without chlorine chemicals, wherein the oxidants used are oxygen and alkaline peroxide, usually a pulp has been obtained which in its brightness, 83–87% ISO, and in its strength is not of the level of pulp bleached with chlorine chemicals. When ozone has been used as the oxidant, a brightness above 88% ISO has been achieved, but there has been the problem of the proneness of the process to disturbances. Thus there has been a need to find a system by means of which, without the use of chlorine chemicals, a fully bleached pulp stronger than previously and corresponding in quality to conventional pulps bleached with chlorine chemicals could be obtained through a process reliable in operation.

It is known that the delignification of chemical pulps can be promoted by treating the pulp with hydrogen peroxide in the presence of certain metals, such as Sn, Ti, V, W, Mo, Cr, Nb, Os and Se, or compounds thereof (1, 2, 3, 4, 5, 6, 7, 8).

Metal compounds which have been used in organic chemistry to activate hydrogen peroxide are listed in, for example, the book Catalytic Oxidations with Hydrogen Peroxide as Oxidant (G. Strukul, Kluwer Academic Publishers 1992), Chapter 1, "Introduction and Activation Principles," page 9.

In the said references, the above-mentioned metallic activators have been used mainly in the peroxide step after the cooking or after the oxygen step.

On the other hand, Weinstock et al. (5) have disclosed a delignification process which is based on the exploitation of heteropolyacids formed by Mo. Heteropolyacid is used in the process as a stoichiometric bleaching chemical. Mo is first oxidized with oxygen, whereafter it is reduced in the bleaching, and the Mo is re-oxidized with oxygen gas after use. However, the process has disadvantages in the shield gas necessary for the reactions and the very high rates of Mo. This method is also not based on the use of hydrogen peroxide.

According to the present invention it has now been observed that the efficacy of peroxide and/or peracid delignification activated with a Ti-, V- or Cr-group transition metal can be increased by adding to the pulp a compound which contains at least one heteroatom, such as Si, P or B, which is capable of forming a heteropolyacid with the activating transition metal.

The chemistry of polyacids formed by transition metals, in particular molybdenum-and tungsten, has been discussed in, for example, the publication Pope, M. T., Heteropoly and Isopoly Oxometalates, Springer-Verlag 1983. Polyacids formed in mildly acidic solutions are classified into isopolyacids, which contain only Mo or W in addition to oxygen and hydrogen, and heteropolyacids, which contain one or two other elements in addition to the above-mentioned atom types.

Heteropolyacids form spontaneously when water-soluble compounds of metal salts and a suitable heteroatom are mixed in mildly acidic conditions. Heteropolyacids with molybdenum and tungsten can be formed by nearly all elements of the Periodic Table of the Elements, with the exception of noble gases; at least 65 elements are known to be capable of participating in the formation of heteropolyacids.

The present invention is based on the surprising observation that the water-soluble salts of certain elements capable of forming heteropolyacids affect the result of bleaching activated with a transition metal. This is assumed to be due to the formation of heteropolyacids.

In the invention it is possible to use a heteroatom-containing compound, which is preferably fed in the same alkaline liquor as is the activating transition metal into the pulp to be delignified. The heteroatom-containing compound and the transition metal in this case react with each other in the solution, or at the latest in the pulp being treated. Compounds suitable for use in the invention include in particular compounds of silicon and phosphorus, such as waterglass or phosphoric acid, which are non-toxic and inexpensive chemicals. Furthermore, the quantity of chemicals required for increasing the efficacy of delignification is very low. According to experiments performed, in order to produce an effective impact, for example silicon is required at a molar ratio of only 1/12 to the molybdenum used as the activator metal.

Especially preferably the compound used in the invention is one which already contains both an activating transition metal, such as molybdenum, vanadium or tungsten, and a heteroatom, such as silicon or phosphorus. Silicomolybdenic acid type compounds can be mentioned as examples of such compounds.

The pH of the activated peroxide and/or peracid treatment may, according to the invention, be within the range 2–7, preferably 4.5–5.5, and the temperature may be within the range 30–120° C., preferably 80–100° C.

In an activated peroxide and/or peracid treatment according to the invention, when used alone peracid gives a better delignification result than does peroxide. It is, however, optimal to use both peroxide and peracid simultaneously. A suitable peroxide is hydrogen peroxide, and suitable peracids include peracetic acid and performic acid.

The activating transition metal is according to the invention preferably molybdenum, which can be used as a suitable compound, for example as an Na molybdenate solution, which is fed into the pulp together with the heteroatom-containing compound but separate from the feed of the peroxide and/or peracid. In the experiments, vanadium and tungsten were used in addition to molybdenum, with good results. It is, however, clear that any transition metals of the above-mentioned groups, known per se, which activate peroxide and/or peracid delignification, can be used in the invention.

In addition to the said heteroatom-containing compounds it is, according to the invention, possible to use in the activated peroxide and/or peracid treatment also other additives, such as acetic acid or other organic acids, which serve as a buffer to maintain the pH at the optimum level, and elements Ni, Cr and Se, which in some cases increase the reactivity of the chemical combinations used.

Furthermore, it is preferable, before the peroxide and/or peracid treatment activated with a transition metal, to subject the pulp to be delignified to chelation for the removal of heavy metals, such as iron, manganese and/or copper, derived from the wood raw material. Thereby these heavy metals are prevented from catalyzing the decomposition of the peroxide and/or peracid, which would increase the consumption of these chemicals in bleaching. Suitable chelation chemicals include in particular DTPA (diethylenetriaminepentaacetic acid), although other chelate-forming substances, such as EDTA (ethylenediaminetetraacetic acid), DTMPA, organic acids, quaternary ammonium compounds, etc., are also possible.

The invention is suitable for all different chemical pulps, such as softwood and hardwood sulfate pulps, sulfite pulps, semialkaline pulps, and organosolv pulps such as alcohol pulps or milox.

The following examples include experiment series in which the effect of the various parameters of bleaching on the results obtained was investigated.

EXAMPLE 1

A softwood sulfate pulp was subjected to a chelation pretreatment, a peroxide-promoted oxygen step (OP), and further a second chelation pretreatment. In the first and second chelation pretreatments, DTPA was used at a rate of 2+1 kg/one metric ton of pulp and in the OP step $H_2O_2$ at a rate of 10 kg/one metric ton of pulp. The kappa number of the obtained pulp was 8.0, brightness 60.5% ISO, and viscosity 840 $dm^3$/kg. The results of the delignification following the pretreatment are shown in Table 1.

TABLE 1

Effect of the reaction conditions on Si/Mo- and P/Mo-activated peroxide delignification of a softwood sulfate pulp

| Exp. No. | 1 | 2 | 3 | 4 | 5 | 6 | 7 | 8 | 9 | 10 | 11 | 12 |
|---|---|---|---|---|---|---|---|---|---|---|---|---|
| Time, min | 120 | 210 | 210 | 210 | 120 | 210 | 210 | 210 | 210 | 210 | 210 | 210 |
| Temperature, ° C. | 80 | 80 | 100 | 80 | 80 | 80 | 100 | 80 | 80 | 80 | 80 | 100 |
| Consistency, % | 12 | 12 | 12 | 22 | 12 | 12 | 12 | 22 | 12 | 12 | 12 | 12 |
| $H_2O_2$, kg/t | 20 | 20 | 20 | 20 | 20 | 20 | 20 | 20 | 20 | 20 | 20 | 20 |
| Mo, kg/t | 0.5 | 0.5 | 0.5 | 0.5 | 0.5 | 0.5 | 0.5 | 0.5 | 0.5 | 0.5 | 0.5 | 0.5 |
| Si, kg/t | 0.04 | 0.04 | 0.04 | 0.04 | — | — | — | — | 0.04 | 0.04 | — | — |
| P, kg/t | — | — | — | — | 0.2 | 0.2 | 0.2 | 0.2 | — | — | — | — |
| Residual $H_2O_2$, kg/t | 10.8 | 8.0 | 4.3 | 5.3 | 11.1 | 8.0 | 4.6 | 5.6 | 7.8 | 0 | 8.4 | 4.8 |
| Kappa number | 4.7 | 3.6 | 2.0 | 2.7 | 4.6 | 3.6 | 2.1 | 2.7 | 3.3 | 4.7 | 4.0 | 2.5 |
| Viscosity, $dm^3$/kg | 822 | 817 | 802 | 811 | 825 | 819 | 800 | 812 | 708 | 810 | 815 | 812 |
| Brightness, % ISO | 67.4 | 69.6 | 72.8 | 71.6 | 67.6 | 69.9 | 72.9 | 71.6 | 67.2 | 64.1 | 68.0 | 70.9 |
| Final pH | 4.7 | 4.7 | 4.6 | 4.7 | 4.6 | 4.6 | 4.7 | 4.7 | 2.4 | 7.0 | 4.8 | 4.6 |

As can be seen from the table, long reaction times (compare Experiments 1 and 2, 5 and 6), a high temperature (compare Experiments 2 and 3, 6 and 7), and a high consistency (compare Experiments 2 and 4, 6 and 8) are optimal for silicate- and phosphorus-modified molybdenum-activated peroxide delignifications. A pH of 4.7 gave a result better than did the references (pH 2.4 and 7).

Comparisons of Experiments 2 and 11 and Experiments 3 and 12 show the improving effect of silicate on the delignification efficacy, and comparisons of Experiments 6 and 11 and Experiments 7 and 12 show, respectively, the improving effect of phosphorus.

The improvement over references (no silicate and no phosphorus) obtained with Si- and P-modified delignifications is also clearly visible in the completed pulp, as indicated below.

Delignified pulps 3 (Experiment No. 3), 7 (Experiment No. 7) and 10 (reference, Experiment No. 10) of Table 1 were chelated (1 kg DTPA/t) and washed before the subsequent alkaline peroxide bleaching (20 kg $H_2O_2$/t). The retention time was 210 min, the temperature 90° C., and the consistency 12%. The properties of the bleached pulps are shown.

TABLE 1b

| Exp. No. | 3 | 7 | 10 |
|---|---|---|---|
| Kappa | 1.0 | 1.1 | 1.4 |
| Brightness, % ISO | 89.0 | 88.8 | 87.7 |
| Viscosity, $dm^3$/kg | 739 | 740 | 744 |

The bleaching advantage obtained with modifications with Si and P is quite significant at the brightness level of Table 1b.

The softwood sulfate pulp used as the raw material in Table 1 had been chelation-pretreated before the delignification experiments. The chelation pretreatment is not indispensable, but it improved the efficacy and selectivity of Si- and P-modified peroxide delignification activated with Mo (or a corresponding metal) by removing detrimental heavy metals, such as Fe, Mn and Cu, which decompose peroxide.

EXAMPLE 2

A softwood sulfate pulp was subjected to a peroxide-promoted oxygen delignification (OP) and a chelation step (2 kg of DTPA/one metric ton of pulp). The kappa number of the obtained pulp was 7.7, brightness 55.8% ISO, and viscosity 800 $dm^3$/kg. Table 2 shows the effect of silicate on Mo-, W- and V-activated peroxide delignifications.

TABLE 2

| Exp. No. | 1 | 2 | 3 | 4 | 5 |
|---|---|---|---|---|---|
| Time, min | 200 | 200 | 200 | 200 | 200 |
| Temperature, ° C. | 90 | 90 | 90 | 90 | 90 |
| Consistency, | 12 | 12 | 12 | 12 | 12 |
| $H_2O_2$, kg/t | 20 | 20 | 20 | 20 | 20 |
| Mo, kg/t | 0.6 | — | — | — | — |
| W, kg/t | — | 0.6 | — | 0.6 | — |
| V, kg/t | — | — | 0.6 | — | 0.6 |
| Si, kg/t | — | — | — | 0.05 | 0.05 |
| Final pH | 4.6 | 4.6 | 4.6 | 4.5 | 4.6 |
| Residual $H_2O_2$, kg/t | 10.2 | 11.5 | 11.9 | 11.0 | 11.1 |
| Kappa | 3.0 | 3.5 | 3.7 | 3.1 | 3.2 |
| Brightness, % ISO | 67.7 | 67.3 | 66.9 | 68.1 | 68.0 |
| Viscosity, $dm^3$,/kg | 743 | 729 | 720 | 731 | 726 |

As is seen from Table 2, silicate improves the efficacy of W- and V-activated peroxide delignifications (compare Experiments 2 and 4 and Experiments 3 and 5).

EXAMPLE 3

A softwood sulfate pulp was subjected to a chelation, an oxygen step and a second chelation step by using 1 kg of DTPA/one metric ton of pulp. The kappa number of the obtained pulp was 7.7, brightness 55.8% ISO, and viscosity 800 $dm^3$/kg. Thereafter, delignification was carried out, the results of which are shown in following Table 3.

TABLE 3

| Exp. No. | 1 | 2 | 3 | 4 | 5 | 6 | 7 | 8 | 9 | 10 |
|---|---|---|---|---|---|---|---|---|---|---|
| Time, min | 200 | 200 | 400 | 200 | 400 | 200 | 200 | 200 | 200 | 200 |
| Temperature, ° C. | 90 | 90 | 90 | 90 | 90 | 90 | 100 | 100 | 100 | 90 |
| Consistency, % | 12 | 12 | 12 | 12 | 12 | 12 | 12 | 12 | 12 | 12 |
| $H_2O_2$, kg/t | 15 | 8.85 | 15 + 7.5 | 15 | 15 + 7.5 | 8.85 | 8.85 | 15 | 15 | 8.85 |
| Mo, kg/t | 0.33 | 0.33 | 0.33 | 0.33 | 0.33 | 0.33 | 0.33 | 0.33 | 0.33 | 0.33 |
| Si, $10^{-3}$ kg/t | — | — | 27.5 | 27.5 | — | 27.5 | 27.5 | 27.5 | — | 27.5 |
| P, kg/t | — | — | — | — | 0.33 | — | — | — | — | — |
| Peracetic acid, kg/t | — | 6.15 | — | — | — | 6.15 | 6.15 | — | — | — |
| Performic acid, kg/t | — | — | — | — | — | — | — | — | — | 6.15 |
| pH, initial | 5.2 | 5.2 | 5.2 | 5.2 | 5.2 | 5.2 | 5.2 | 5.2 | 5.2 | 5.2 |
| pH, final | 4.4 | 4.7 | 5.1 | 4.7 | 5.2 | 4.9 | 4.9 | 4.7 | 4.6 | 4.6 |
| Residual $H_2O_2$, kg/t | 8.5 | 3.9 | 12.7 | 8.8 | 11.5 | 4.3 | 2.3 | 6.8 | 7.2 | 4.9 |
| Kappa | 3.6 | 3.2 | 2.6 | 3.4 | 2.7 | 3.1 | 2.3 | 2.7 | 2.9 | 3.6 |
| Brightness, % ISO | 64.9 | 67.1 | 71.5 | 66.1 | 71.5 | 68.0 | 70.3 | 68.4 | 67.0 | 64.6 |
| Viscosity $dm^3$/kg | 758 | 748 | 751 | 768 | 748 | 771 | 710 | 726 | 730 | 741 |

In Experiments 3 and 5, some of the chemicals were added after 200 min, in connection with pH control (pH 5.2).

Comparisons of Experiments 1 and 4 and Experiments 2 and 6 of Table 3 show that the use of silicate improves the final results of both molybdenum-activated peroxide delignification and molybdenum-activated peracetic acid/peroxide delignification.

The use of phosphorus instead of silicate gives an almost equally good result, as shown by a comparison of Experiments 3 and 5.

An increase of the temperature increases the efficacy of silicate-modified molybdenum-activated peracetic acid/peroxide delignification (compare Experiments 6 and 7). An increase of the bleaching chemical charge and/or the reaction time also increases the efficacy of the delignifications concerned, as is shown by comparisons of Experiments 4 and 8, 6 and 7, and 3 and 4.

EXAMPLE 4

A softwood sulfate pulp was subjected to peroxide-promoted oxygen delignification and to a chelation step by using 2 kg of DTPA/one metric ton of pulp. The kappa number of the obtained pulp was 7.4, brightness 62.2% ISO, and viscosity 895 $dm^3$/kg. The results of delignification steps carried out on this pulp are shown in Table 4.

TABLE 4

| Exp. No. | 1 | 2 | 3 | 4 | 5 |
|---|---|---|---|---|---|
| Time, min | 2 + 2 | 210 | 210 | 180 | 210 |
| Temperature, ° C. | 50 | 90 | 90 | 75 | 90 |
| Consistency, | 12 | 12 | 12 | 10 | 12 |
| $H_2O_2$, kg/t | — | 20 | 20 | — | 20 |
| Mo, kg/t | — | 0.8 | 0.8 | — | — |
| Si, kg/t | — | — | 0.067 | — | — |
| $O_3$, kg/t | 3 + 3 | — | — | — | — |
| $ClO_2$, kg act. Cl/t | — | — | — | 30 | — |
| pH, final | 2.9 | 4.5 | 4.9 | 2.2 | 10.3 |
| Residual $H_2O_2$, kg/t | — | 8.8 | 9.6 | — | 8.3 |

TABLE 4-continued

| Exp. No. | 1 | 2 | 3 | 4 | 5 |
|---|---|---|---|---|---|
| Kappa | 2.8 | 2.8 | 2.6 | 2.1 | 4.3 |
| Brightness, % ISO | 69.9 | 67.5 | 70.2 | 70.8 | 81.3 |
| Viscosity, $dm^3$/kg | 717 | 831 | 824 | 848 | 802 |

Pulps 1, 2, 3 and 5 of Table 4 were further subjected to a chelation step, and the chlorine dioxide delignified pulp No. 4 to an alkali (E) step. Washed pulps 1, 2, 3 and 5 were further subjected to an alkaline peroxide treatment and, respectively, pulp 4 after an alkali and washing step to a chlorine dioxide (D) step. The bleaching experiments of Table 4a were continued on after the correspondingly numbered experiments of Table 4.

TABLE 4a

| Exp. No. | 1 | 2 | 3 | 4 | 5 |
|---|---|---|---|---|---|
| Time, min | 210 | 210 | 210 | 180 | 210 |
| Temperature, ° C. | 90 | 90 | 90 | 80 | 90 |
| Consistency, | 12 | 12 | 12 | 12 | 12 |
| $H_2O_2$, kg/t | 25 | 25 | 25 | — | 25 |
| $ClO_2$, kg act. Cl/t | — | — | — | 15 | — |
| Final pH | 10.2 | 10.3 | 10.3 | 4.6 | 10.3 |
| Residual $H_2O_2$, kg/t | 19.2 | 17.7 | 19.4 | — | 22.6 |
| Residual $ClO_2$, kg/t | — | — | — | 0.3 | — |
| Kappa | 1.4 | 1.5 | 1.4 | 0.6 | 2.6 |
| Brightness, % ISO | 86.9 | 87.2 | 88.1 | 88.3 | 86.1 |
| Viscosity, $dm^3$/kg | 656 | 759 | 750 | 786 | 751 |

In addition to brightness, strength properties corresponding to those of a chlorine dioxide bleached pulp (No. 4) were obtained for the pulps (Nos. 2 and 3) after alkaline peroxide bleachings which followed activated peroxide delignification: with a tensile index of 70, a tear index of 14 was achieved, which is a strength result about 10% better than that obtained with a conventional alkaline peroxide-bleached TCF pulp (No. 5). The improving effect of silicon on the results is shown by a comparison of Experiment 3 with Experiment 2.

EXAMPLE 5

A softwood sulfate pulp was subjected to a peroxide-promoted oxygen delignification and a chelation step in which 2 kg of DTPA/one metric ton of pulp was used. The kappa number of the obtained pulp was 7.7, brightness 55.8% ISO, and viscosity 800 $dm^3$/kg. The results of vanadium- and tungsten-activated peroxide and peroxide/peracid delignification steps carried out on this pulp are shown in Table 5.

TABLE 5

| Experiment No. | 1 | 2 | 3 | 4 | 5 | 6 | 7 | 8 |
|---|---|---|---|---|---|---|---|---|
| Time, min | 200 | 200 | 200 | 200 | 200 | 200 | 200 | 200 |
| Temperature ° C. | 90 | 90 | 90 | 90 | 90 | 90 | 90 | 90 |
| Consistency, % | 12 | 12 | 12 | 12 | 12 | 12 | 12 | 12 |
| $H_2O_2$, kg/t | 20 | 20 | 20 | 20 | 11.8 | 11.8 | 11.8 | 11.8 |
| Peraetic acid, kg/t | — | — | — | — | 8.2 | 8.2 | 8.2 | 8.2 |
| W, kg/t | 0.6 | — | 0.6 | — | 0.6 | — | 0.6 | — |
| V, kg/t | — | 0.6 | — | 0.6 | — | 0.6 | — | 0.6 |
| Si, kg/t | — | — | 0.05 | 0.05 | — | — | 0.05 | 0.05 |
| Final pH | 4.6 | 4.6 | 4.5 | 4.6 | 4.4 | 4.5 | 4.5 | 4.5 |
| Residual $H_2O_2$, kg/t | 11.5 | 11.9 | 11.0 | 11.1 | 3.1 | 3.3 | 3.1 | 3.2 |
| Kappa | 3.5 | 3.7 | 3.3 | 3.4 | 3.0 | 3.2 | 2.9 | 3.0 |
| Brightness, % ISO | 67.3 | 66.9 | 68.1 | 68.0 | 69.9 | 69.6 | 70.7 | 70.5 |

As can be seen from Table 5, an addition of silicate improves both W- and V-activated peroxide delignifications and W- and V-activated peroxide/peracid delignifications. The viscosity values of the delignified pulps of Table 5 were within the range 710–740 $dm^3$/kg.

EXAMPLE 6

Birch sulfate pulp was subjected to oxygen delignification and chelation by using 2 kg of DTPA/one metric ton of pulp. The kappa number of the obtained pulp was 10, brightness 52.7% ISO, and viscosity 863 $dm^3$/kg. The results of an Mo-activated peroxide delignification performed on this pulp are shown in Table 6.

| Experiment No. | 1 | 2 |
|---|---|---|
| Time, min | 210 | 210 |
| Temperature, ° C. | 90 | 90 |
| Consistency, % | 12 | 12 |
| $H_2O_2$, kg/t | 25 | 25 |
| Mo, kg/t | 0.8 | 0.8 |
| Si, $10^{-3}$ kg/t | — | 66.6 |
| DTPA, kg/t | 1 | 1 |
| Residual $H_2O_2$, kg/t | 6.8 | 4.7 |
| pH, initial | 5.2 | 5.2 |
| pH, final | 4.6 | 4.8 |
| Kappa | 3.6 | 3.3 |
| Brightness, % ISO | 66.7 | 69.0 |
| Viscosity, $dm^3$/kg | 827 | 813 |
| | ↓ | ↓ |
| | Q | Q |
| | ↓ | ↓ |
| | EP | EP |
| Residual $H_2O_2$, kg/t | 14.7 | 16.3 |
| Kappa | 1.6 | 1.5 |
| Brightness, % ISO | 87.3 | 87.8 |
| Viscosity, $dm^3$/kg | 742 | 758 |

Q: 2 kg DTPA/t, 45 min, 70° C., Cs 5%, pH 5.5
EP: 25 kg $H_2O_2$/t, 210 min, 90° C., Cs 12, final pH 10

As can be seen in Table 6, silicomolybdenum-activated peroxide delignification (Experiment No. 2) gives a better result than does molybdenum-activated peroxide delignification (Experiment No. 1). The brightness values of the subsequent alkaline peroxide step are also better than those of the reference.

In a bleaching sequence based on alkaline peroxide bleaching, the kappa number of bleached birch pulp usually remains at a level of 3–4. By the processes mentioned above, the kappa number of a birch sulfate pulp can be caused to drop lower than this, which means, among other things, reduced after-yellowing.

EXAMPLE 7

An oxygen-prebleached softwood sulfate pulp having a kappa number of 8.4, a brightness of 52.7% ISO and a viscosity of 827 $dm^3$/kg was subjected to an Mo- or W-activated peroxide delignification (mP), chelation (Q), and finally an alkaline peroxide treatment (EP). The results are shown in the following Table 7.

TABLE 7

| Activator | Mo | Mo | Mo | Mo | W | W | Mo | Mo | W | Mo | Mo | Mo | W |
|---|---|---|---|---|---|---|---|---|---|---|---|---|---|
| Heteroatom | | | Si | P | Si | P | — | Co | Co | P | Si | P + V | — |
| RM (1:X) | — | — | 12 | 12 | 18 | 9 | — | 5 | 5 | 1 | 1 | 12:6 | — |
| | | | | | | mP | | | | | | | |
| t/min | 200 | 200 | 200 | 200 | 200 | 200 | 200 | 200 | 200 | 200 | 200 | 200 | 200 |
| T/C | 90 | 90 | 90 | 90 | 90 | 90 | 90 | 90 | 90 | 90 | 90 | 90 | 90 |
| Consistency, % | 12 | 12 | 12 | 12 | 12 | 12 | 12 | 12 | 12 | 12 | 12 | 12 | 12 |
| $H_2O_2$, kg/t | 20 | 20 | 20 | 20 | 20 | 20 | 20 | 20 | 20 | 20 | 20 | 20 | 20 |
| Mo, kg/tm | 1 | 0.66 | 0.66 | 0.66 | 0.66 | 0.66 | 0.66 | 0.66 | 0.66 | 0.66 | 0.66 | 0.66 | 0.66 |
| Initial pH | 5.50 | 5.50 | 5.50 | 5.50 | 5.50 | 5.50 | 5.50 | 5.50 | 5.50 | 5.50 | 5.50 | 5.50 | 5.50 |
| Final pH | 5 | 4.7 | 4.6 | 4.9 | 6.1 | 5.1 | 4.7 | 5.5 | 5.6 | 5 | 4.7 | 4.7 | 4.8 |
| Residual $H_2O_2$, kg/t | 8.4 | 2.23 | 9.2 | 7.9 | 14.1 | 11.2 | 7 | 0.1 | 0 | 8.8 | 9.2 | 10.7 | 11 |
| | | | | | | Q | | | | | | | |
| t/min | 15 | 15 | 15 | 15 | 15 | 15 | 15 | 15 | 15 | 15 | 15 | 15 | 15 |
| T/C | 80 | 80 | 80 | 80 | 80 | 80 | 80 | 80 | 80 | 80 | 80 | 80 | 80 |
| Consistency, % | 10 | 10 | 10 | 10 | 10 | 10 | 10 | 10 | 10 | 10 | 10 | 10 | 10 |
| EDTA, kg/t | 1.5 | 1.5 | 1.5 | 1.5 | 1.5 | 1.5 | 1.5 | 1.5 | 1.5 | 1.5 | 1.5 | 1.5 | 1.5 |
| Initial pH | 5.5 | 5.5 | 5.5 | 5.5 | 5.5 | 5.5 | 5.5 | 5.5 | 5.5 | 5.5 | 5.5 | 5.5 | 5.5 |
| Final pH | 5.5 | 5.5 | 5.5 | 5.5 | 5.5 | 5.5 | 5.5 | 5.5 | 5.5 | 5.5 | 5.5 | 5.5 | 5.5 |
| Kappa | 3.1 | 3.5 | 2.8 | 2.9 | 7 | 3.7 | 3.3 | 6.2 | 6.2 | 2.9 | 2.9 | 3 | 3.2 |
| Viscosity, $dm^3$/kg | 788 | 763 | 783 | 713 | 818 | 772 | 797 | 683 | 649 | 768 | 748 | 767 | 741 |
| Brightness, % ISO | 70.3 | 70.5 | 71.3 | 72 | 71.1 | 70.1 | 71.4 | 63.4 | 64.9 | 72.2 | 72.5 | 72.1 | 71.2 |
| | | | | | | EP | | | | | | | |
| t/min | 240 | 240 | 240 | 240 | 240 | 240 | 240 | 240 | 240 | 240 | 240 | 240 | 240 |
| T/C | 80 | 80 | 80 | 80 | 80 | 80 | 80 | 80 | 80 | 80 | 80 | 80 | 80 |
| Consistency, % | 17 | 17 | 17 | 17 | 17 | 17 | 17 | 17 | 17 | 17 | 17 | 17 | 17 |
| $H_2O_2$, kg/t | 20 | 20 | 20 | 20 | 20 | 20 | 20 | 20 | 20 | 20 | 20 | 20 | 20 |
| NaOH, kg/t | 10 | 10 | 10 | 10 | 10 | 10 | 10 | 10 | 10 | 10 | 10 | 10 | 10 |
| Initial pH | 10.5 | 10.5 | 10.5 | 10.5 | 10.5 | 10.5 | 10.5 | 10.5 | 10.5 | 10.5 | 10.5 | 10.5 | 10.5 |
| Final pH | 10.4 | 10.9 | 10.3 | 10.3 | 10.2 | 10.3 | 10.3 | 10 | 9.8 | 10.1 | 10.2 | 10 | 10.3 |
| Residual $H_2O_2$, kg/t | 12.5 | 2.8 | 13.5 | 12.3 | 16.6 | 12.8 | 11.3 | 3.4 | 3.7 | 13.8 | 9.5 | 15.3 | 8.8 |
| Residual alkali kg/t | 5.1 | 5.5 | 5.9 | 4.9 | 5.4 | 4.2 | 3.8 | 5.7 | 4.3 | 6.3 | 6.4 | 6 | 3.9 |
| Kappa | 2.2 | 2.4 | 1.6 | 1.6 | 4.8 | 2.1 | 2.3 | 4.3 | 4.1 | 1.9 | 1.8 | 1.9 | 2.1 |
| Viscosity, $dm^3$/kg | 754 | 724 | 731 | 749 | 783 | 707 | 697 | 599 | 562 | 725 | 728 | 719 | 697 |
| Brightness, % IS0 | 84.9 | 84.1 | 86 | 85.9 | 81.4 | 85.3 | 84.5 | 83.1 | 83.4 | 85.9 | 86.4 | 85.6 | 85.4 |

The results show that silicon and phosphorus, which were used as heteroatoms, all had an improving effect on delignification.

EXAMPLE 8

An oxygen-prebleached softwood sulfate pulp having a kappa number of 7.7, a brightness of 55.8% ISO, and a viscosity of 789 $dm^3$/kg was subjected to an Mo-activated peroxide delignification (mP) wherein the temperature was 90°, the treatment time 200 min, the consistency 12%, the $H_2O_2$ amount 20 kg/t, the initial pH 5.2, and the Mo amount 0.66 kg/t, thereafter to chelation (Q) wherein the temperature was 80° C., the treatment time 15 min, the chelation chemical EDTA 1.5 kg/t, and the pH 5.5, and finally to an alkaline peroxide treatment (EP) wherein the temperature was 80° C., the treatment time 240 min, the consistency 17%, the alkali amount 10–11 kg NaOH/t, the $H_2O_2$ amount 20 kg/t, and the pH 10.4. The results are shown in the following Table 8.

TABLE 8

| Heteroatom (het) | — | I | Ce(IV) | P | B |
|---|---|---|---|---|---|
| Molar ratio, het(Mo) | — | ⅙ | ⅛ | ⅛ | ⅛ |
| $H_2SO_4$, kg/t | 0.8 | 0.8 | 0.8 | 0.8 | 0.8 |
| Final pH | 4.7 | 4.6 | 4.7 | 4.6 | 4.6 |

TABLE 8-continued

| Heteroatom (het) | — | I | Ce(IV) | P | B |
|---|---|---|---|---|---|
| Residual $H_2O_2$, kg/t | 15 | 11.3 | 6.6 | 13.8 | 15 |
| Q (chelation) | | | | | |
| Viscosity, $dm^3$/kg | 734 | 744 | 755 | 755 | 742 |
| Kappa | 3.2 | 2.9 | 2.9 | 2.7 | 3 |
| Brightness, % ISO | 69.6 | 69.3 | 68.8 | 67.7 | 65 |
| EP (alkaline peroxide) | | | | | |
| Final pH | 10.3 | 10.4 | 10.2 | 10.2 | 10.2 |
| Residual $H_2O_2$, kg/t | 14.9 | 11.8 | 13 | 12.6 | 11.9 |
| Residual alkali, kg/t | 7.2 | 5.5 | 6 | 5.5 | 5.5 |
| Viscosity, $dm^3$/kg | 686 | 685 | 617 | 683 | 678 |

TABLE 8-continued

| Heteroatom (het) | — | I | Ce(IV) | P | B |
|---|---|---|---|---|---|
| Kappa | 1.8 | 1.6 | 1.5 | 1.5 | 1.7 |
| Brightness, % ISO | 85.5 | 86.2 | 86.3 | 86.1 | 85.8 |

It can be seen that iodine (in the form of $H_5IO_6$), cerium, phosphorus and boron used as heteroatoms all had improving effects on delignification; with cerium, however, as a counterbalance to good brightness the viscosity was poorer.

For an expert in the art it is clear that the various applications of the invention are not limited to those presented above as examples; they can vary within the accompanying claims.

LIST OF REFERENCES

1. Latosh M. V., Reznikov V. M., Alekseev A. D., "Method for oxidative delignification of plant raw materials," USSR pat. 699,064. Application filed on Apr. 8, 1977.
2. Eckert R. C., "Delignification and bleaching process and solution for lignocellulosic pulp with peroxide in the presence of metal additives," CA pat. 1,129,161. Application filed on Jan. 18, 1979.
3. Kempf A. W., "Delignification and bleaching process and solution for lignocellulosic pulp with peroxide in the presence of metal additives," U.S. Pat. No. 4,410,397. Application filed on Dec. 24, 1980.
4. Kubelka V., Francis R. C., Dence C. W., "Delignification with acidic hydrogen peroxide activated by molybdate," Journal of Pulp and Paper Science: vol. 18, No. 3, May 1992, pp. J 108–114.
5. Weinstock I. A., Springer E. L., Minor J. L., Atalla R. H., "Alternative pathways in non-chlorine bleaching," Non-chlorine bleaching conference, Mar. 14–18, 1993. S. Carolina, USA.
6. Mounteer A. H., Colodette J. L., Gomide J. L., Campos A. S., "Alternativas para branquamento sem cloro molecular," O Papel 53, No. 4, April 1992, pp. 25–35.
7. Sundman G. I., "Ph.D. Dissertation, SUNY College Environment Science and Forestry, Syracuse, USA, 1988.
8. Ow S. S., Singh R. P., "Method of bleaching lignocellulosic material with peroxide catalyzed with a salt of a metal," U.S. Pat. No. 4,661,205. Application filed on Aug. 28, 1981.

What is claimed is:

1. A process for the delignification of a chemical pulp, in which process the pulp is treated with a peroxide or a peracid in the presence of an activating transition metal wherein the treatment is carried out at a pH within the range of 2 to 7, and a compound which contains at least one heteroatom which is capable of forming a heteropolyacid with the activating transition metal, is added to the pulp;

wherein the heteroatom-containing compound is fed into the pulp in the same alkaline solution as is the activating transition metal; and wherein the compound which contains an activating transitory metal and a heteroatom is a silicomolybdenic acid compound.

2. A process according to claim 1, wherein the pulp is treated with a mixture of a peroxide and a peracid.

3. A process according to claim 1, wherein the peroxide is hydrogen peroxide and the peracid is peracetic acid.

4. A process according to claim 1, wherein the pH of the treatment is within the range 4.5 to 5.5 and the temperature is within the range 30–120° C.

5. A process according to claim 4, wherein the temperature is within a range of 80–100° C.

6. A process according to claim 1, wherein before the above-mentioned activated peroxide or peracid treatment the pulp is chelated for the removal of heavy metals, derived from the wood raw material.

7. A process according to claim 6, wherein said heavy metals are selected from the group consisting of Fe, Mn and Cu.

8. A process according to claim 6, wherein the chelation chemical is DTPA.

* * * * *